US008011850B1

(12) United States Patent
Perlsweig

(10) Patent No.: US 8,011,850 B1
(45) Date of Patent: Sep. 6, 2011

(54) DEVICE FOR ARRESTING A MOVING MOTOR VEHICLE AND METHOD OF USE

(76) Inventor: Leon Perlsweig, Woodland Hills, CA (US)

( * ) Notice: Subject to any disclaimer, the term of this patent is extended or adjusted under 35 U.S.C. 154(b) by 7 days.

(21) Appl. No.: 12/802,696

(22) Filed: Jun. 11, 2010

(51) Int. Cl.
*E01F 13/12* (2006.01)

(52) U.S. Cl. ..... 404/6; 244/110 R; 256/1; 160/351

(58) Field of Classification Search .. 404/6; 244/110 R; 256/1; 160/351; 89/1.1; *E01F 13/04, 13/12*
See application file for complete search history.

(56) References Cited

U.S. PATENT DOCUMENTS 4,768,417 A * 9/1988 Wright ..... 89/1.11
5,494,240 A * 2/1996 Waugh ..... 244/137.4
5,583,311 A * 12/1996 Rieger ..... 89/1.11
5,752,691 A * 5/1998 Bashon et al. ..... 256/35
6,325,015 B1 12/2001 Garcia et al.
6,470,260 B2 10/2002 Martens et al.
7,210,875 B1 5/2007 Christle et al.
7,441,511 B2 10/2008 Farinella et al.

* cited by examiner

*Primary Examiner* — Gary S Hartmann
(74) *Attorney, Agent, or Firm* — Timothy Thut Tyson; Ted Masters; Freilich, Hornbaker & Rosen

(57) ABSTRACT

A device for arresting a motor vehicle which is moving on a support surface includes an enclosure with is shaped and dimensioned to receive the motor vehicle. The device is releasably connectable to a helicopter, so that the device can be (1) positioned over the motor vehicle by the helicopter, (2) disconnected from the helicopter, and (3) dropped onto the support surface wherein the enclosure encloses the motor vehicle.

15 Claims, 12 Drawing Sheets

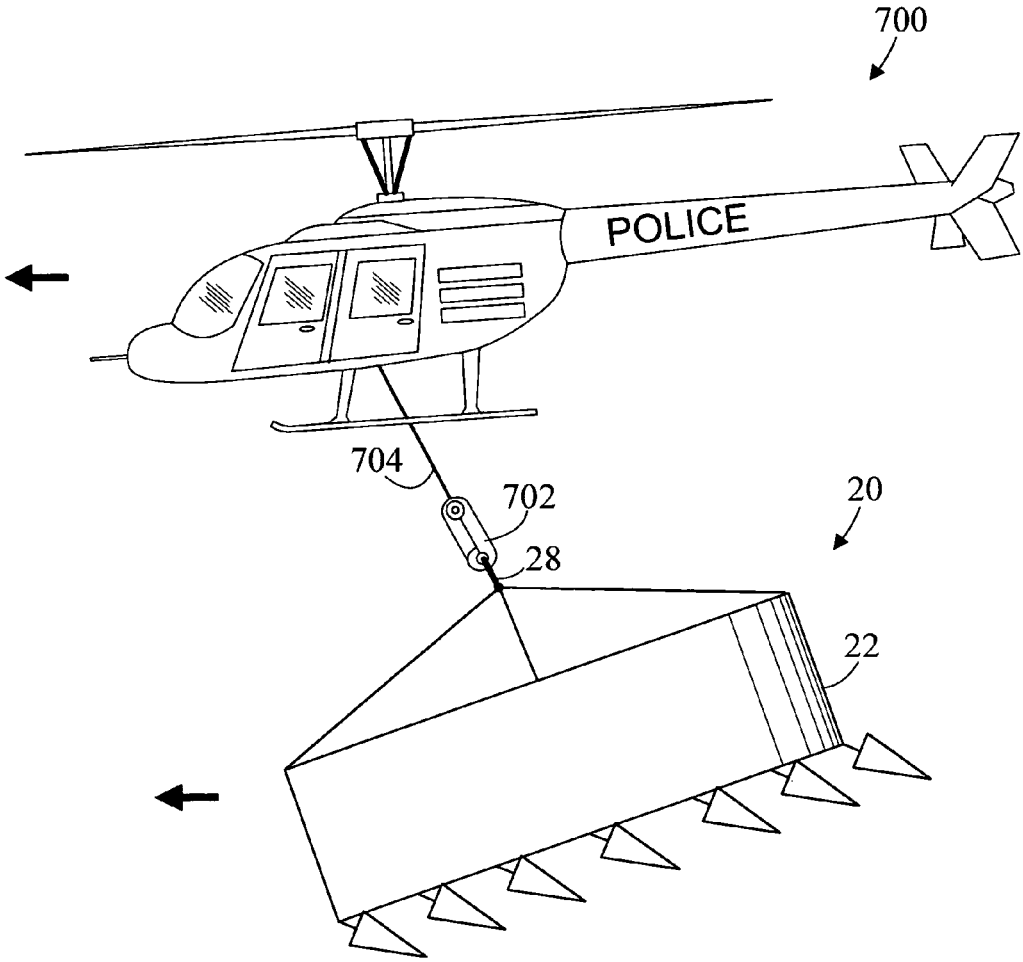
Fig. 13
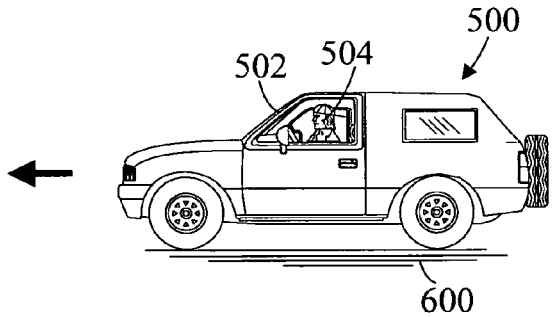

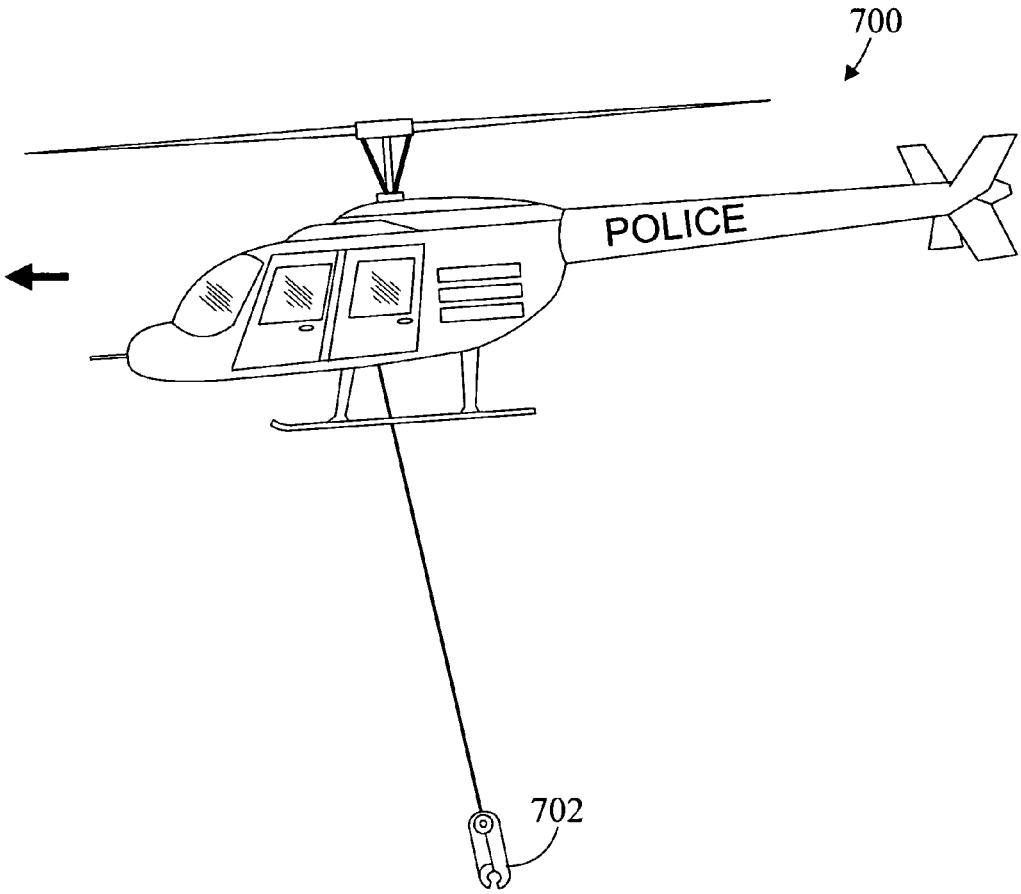
Fig. 16
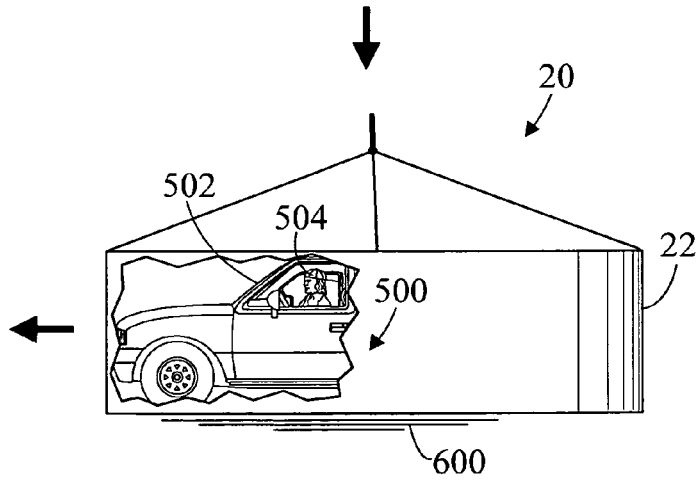

DEVICE FOR ARRESTING A MOVING MOTOR VEHICLE AND METHOD OF USE

TECHNICAL FIELD

The present invention pertains generally to law enforcement, and more particularly to a device for arresting a moving motor vehicle which is being pursued by law enforcement officers.

BACKGROUND OF THE INVENTION

A car chase occurs when the driver of a motor vehicle attempts to escape from law enforcement officers. The chase can last for hours and usually involves the fleeing motor vehicle as well as numerous law enforcement vehicles. Car chases present a major safety problem for the escaping driver, the pursuing law enforcement officers, other motorists, and pedestrians.

Various law enforcement agencies have different protocols which dictate how to stop the motor vehicle and capture the fleeing driver while minimizing risk to themselves and bystanders. Road blocks and tire shredders are two commonly utilized methods, as well as simply waiting for the motor vehicle to run out of gas. However, with any methodology there exists the risk of injury or death to uninvolved individuals, and the resulting legal consequences.

Similar techniques are used to stop trucks, buses, motorcycles, and other motor vehicles. Different techniques are used to stop motor boats.

BRIEF SUMMARY OF THE INVENTION

The present invention is directed to a device for arresting (i.e. causing to slow down or stop) a fleeing motor vehicle which is moving on a support surface, the motor vehicle usually having windows through which a driver views a surrounding driving environment. The device includes an enclosure which is dropped around the motor vehicle from a helicopter. In an embodiment of the device the enclosure is nontransparent so that once it is in place around the motor vehicle the driver can no longer see the surrounding driving environment. As a result, the driver is unable to effectively maneuver the motor vehicle, feels confined, is intimidated, will slow down or stop, and will tend to offer less resistance to law enforcement officers. Additionally, since the device encircles the driver, it lessens the chance of a getaway by foot.

In accordance with one embodiment, a device for arresting a motor vehicle which is moving on a support surface includes an enclosure which is shaped and dimensioned to receive the motor vehicle. The device is releasably connectable to a helicopter, so that the device can be (1) positioned over the motor vehicle by the helicopter, (2) disconnected from the helicopter, and (3) dropped onto the support surface wherein the device encloses the motor vehicle.

In accordance with another embodiment, the enclosure is circular and completely surrounds the motor vehicle.

In accordance with another embodiment, the enclosure is nontransparent and blocks the driver's view of the surrounding driving environment.

In accordance with another embodiment, the enclosure includes a frame which is covered by a nontransparent sheet.

In accordance with another embodiment, the enclosure is fabricated from a solid nontransparent material.

In accordance with another embodiment, the enclosure has a bottom edge. A plurality of sharp elements are disposed on the bottom edge.

In accordance with another embodiment, a plurality of pennants are attached to the bottom edge of the enclosure.

In accordance with another embodiment, the helicopter has a quick release lifting hook. A coupling is connected to the enclosure, and is releasably connectable to the quick release lifting hook.

Other possible embodiments, in addition to the possible embodiments enumerated above, will become apparent from the following detailed description, taken in conjunction with the accompanying drawings, which illustrate, by way of example, the principles of the device and its method of use.

BRIEF DESCRIPTION OF THE DRAWINGS

FIG. 13 is a reduced side elevation view of the device connected to a helicopter and being positioned over the motor vehicle;

FIG. 16 is a reduced side elevation cutaway view of the device surrounding the motor vehicle;

DETAILED DESCRIPTION OF THE INVENTION

Figure 1:
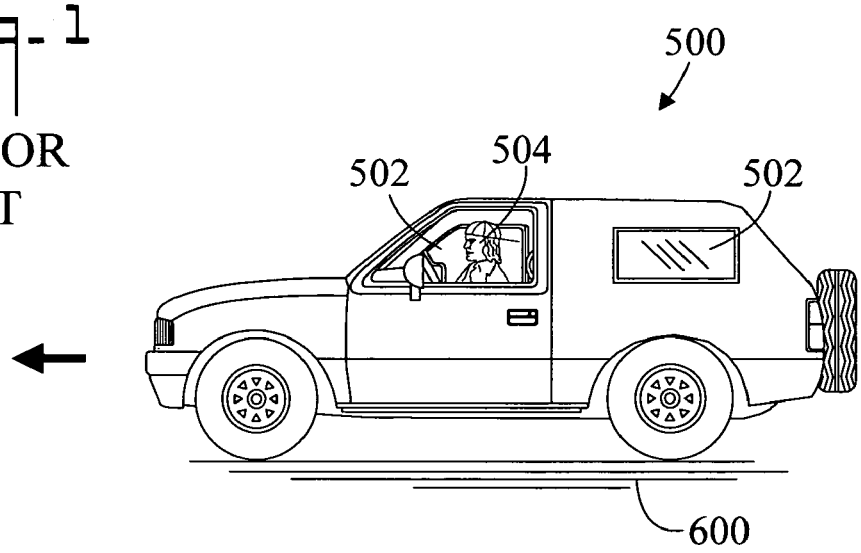
Fig. 1 PRIOR ART
FIG. 1 is a side elevation view of a prior art motor vehicle.
Figure 2:
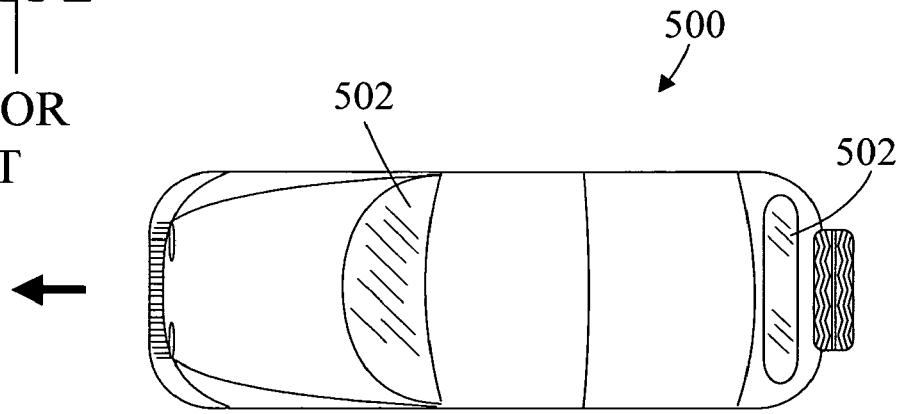
Fig. 2 PRIOR ART
FIG. 2 is a top plan view of the motor vehicle.

Referring initially to FIGS. 1 and 2, there are illustrated side elevation and top plan views, respectively, of a prior art motor vehicle 500 which is moving on a support surface 600 (such as a road, driveway, alley, parking lot, field, or other substantially flat surface). Motor vehicle 500 has windows 502 through which a driver 504 views a surrounding driving environment (e.g. road direction, other vehicles, pedestrians, posts and signs, trees and other vegetation, buildings, curbs and other obstacles, etc.). Windows 502 include a windshield which the driver looks through to drive the motor vehicle 500 in a forward direction. Motor vehicle 500 is moving forward in the direction of the arrow, and constitutes the fleeing vehicle in a car chase.

Figure 3:
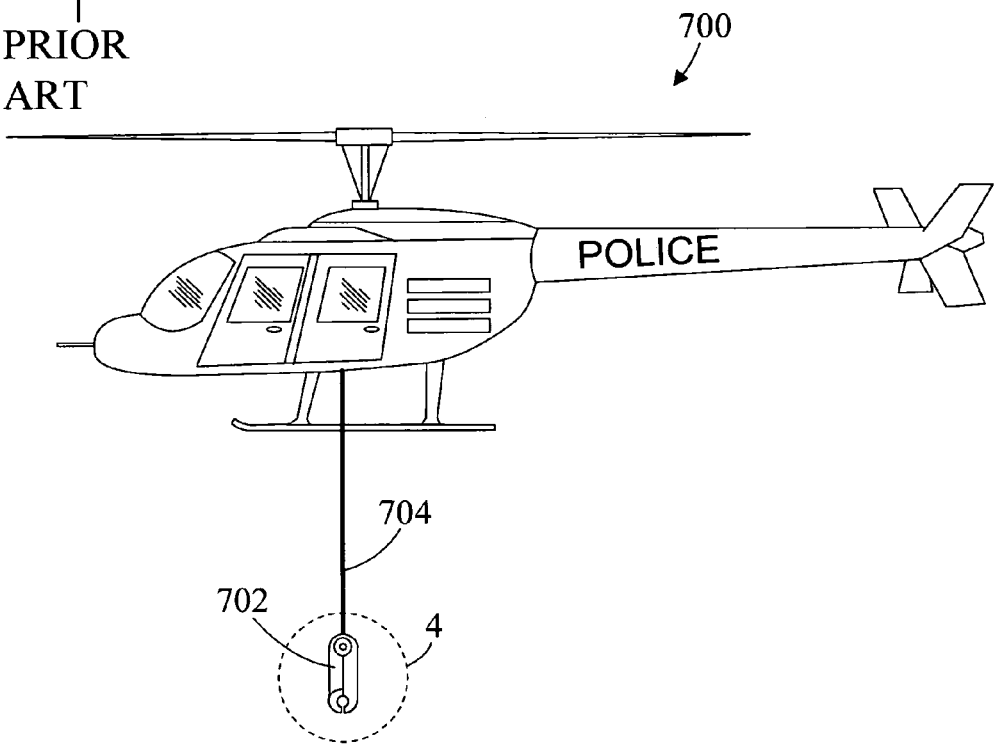
Fig. 3 PRIOR ART
FIG. 3 is a reduced side elevation view of a helicopter.

FIG. 3 is a reduced side elevation view of a prior art helicopter 700. Helicopter 700 includes a prior art quick release lifting hook 702 which is suspended from a cable 704. Cable 704 and quick release lifting hook 702 can be selectively extended or retracted by a conventional winch mechanism (not shown).

Figure 4:
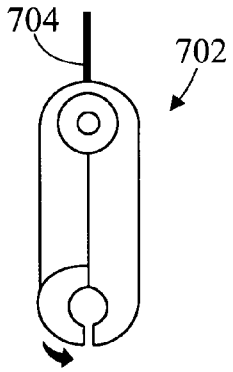
Fig. 4 PRIOR ART
FIG. 4 is an enlarged view of area 4 of FIG. 3 showing a quick release lifting hook in a closed position.

FIG. 4 is an enlarged view of area 4 of FIG. 3 showing quick release lifting hook 702 in a closed position. In the closed position, quick release lifting hook 702 captures the coupling of a load.

Figure 5:
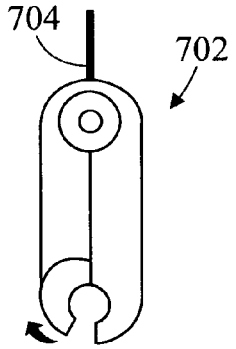
Fig. 5 PRIOR ART
FIG. 5 is an enlarged view of the quick release lifting hook in an open position.

FIG. 5 is an enlarged view of quick release lifting hook 702 in an open position. In the open position, quick release lifting hook 702 opens to release the coupling of the load. Quick release lifting hook 702 can be remotely operated from the helicopter by a lanyard, electrically (such as with explosive bolts), or hydraulically.

Figure 6:
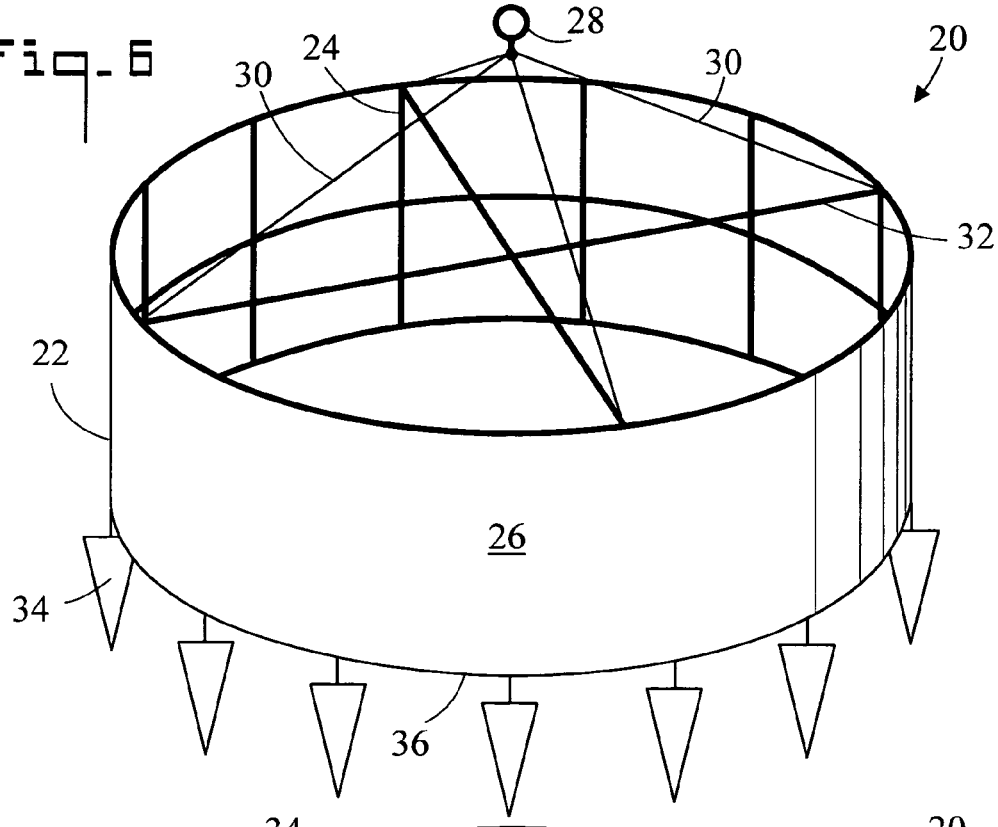
FIG. 6 is a perspective view of an enclosure for arresting a motor vehicle with the non-transparent sheet on the outside of the frame.
Figure 7:
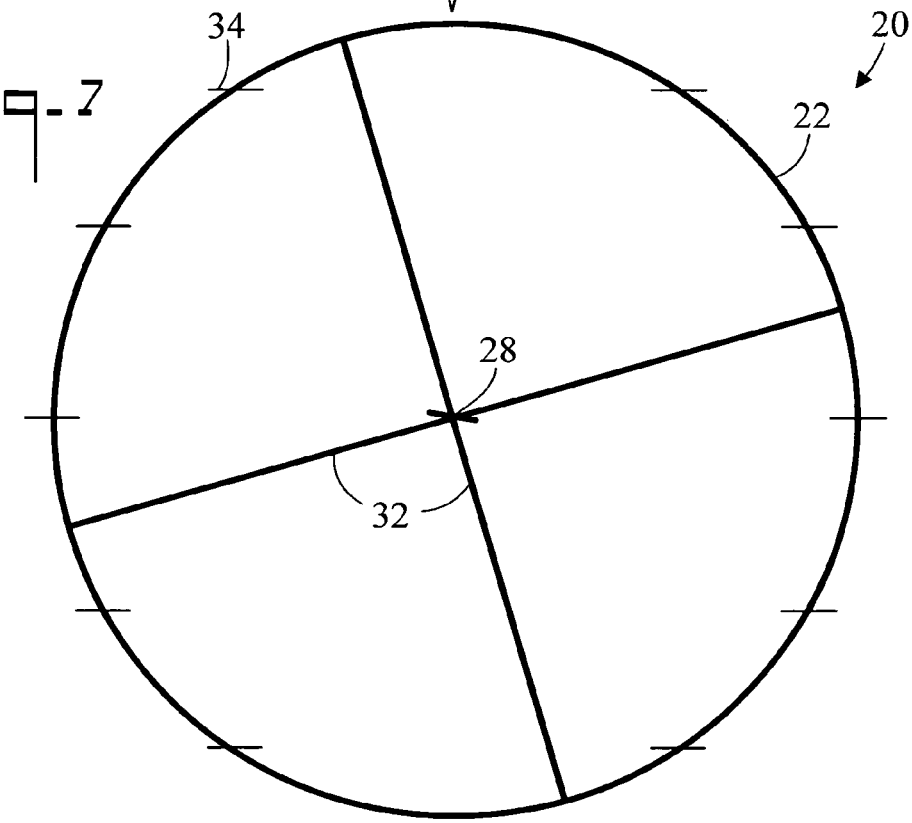
FIG. 7 is a top plan view of the enclosure.
Figure 8:
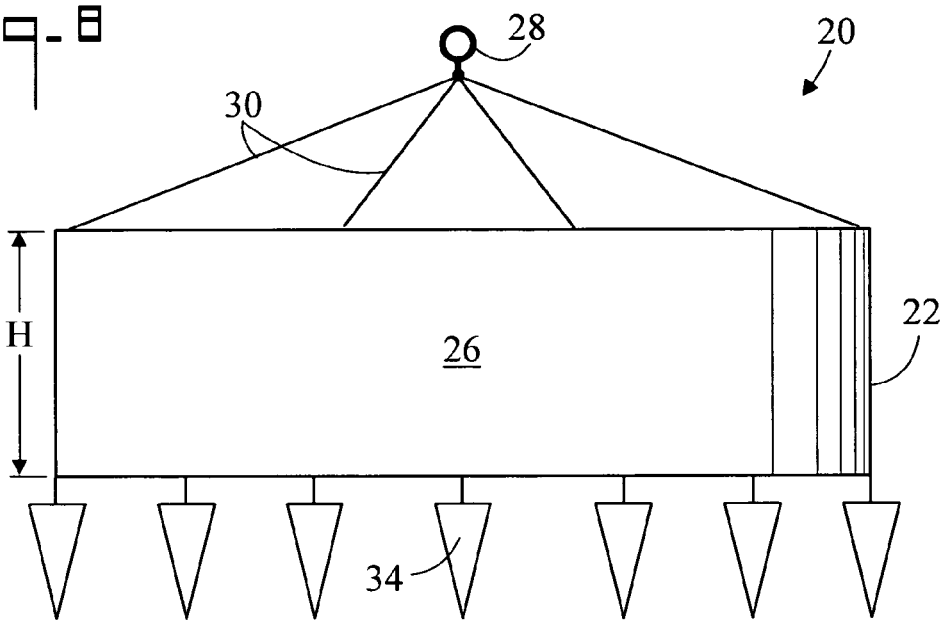
FIG. 8 is a side elevation view of the enclosure.

Now referring to FIGS. 6-8, there are illustrated perspective, top plan, and side elevation views respectively of a device for arresting motor vehicle 500 which is moving on support surface 600 (refer to FIGS. 1-2), the device generally designated as 20. As will be discussed below, device 20 is deployed by helicopter 700 (refer to FIG. 3). Device 20 includes an enclosure 22 which is shaped and dimensioned to receive motor vehicle 500. That is, enclosure 22 is larger than motor vehicle 500 so that motor vehicle 500 fits inside enclosure 22. In use, device 20 is releasably connectable to helicopter 700, so that device 20 can be (1) positioned over motor vehicle 502 by helicopter 700, (2) disconnected from helicopter 700, and (3) dropped onto support surface 600 wherein enclosure 22 encloses motor vehicle 500 (refer to FIGS. 13-18). To position device 20, helicopter 700 flies at the same speed and direction, and slightly in front of motor vehicle 500.

Figure 17:
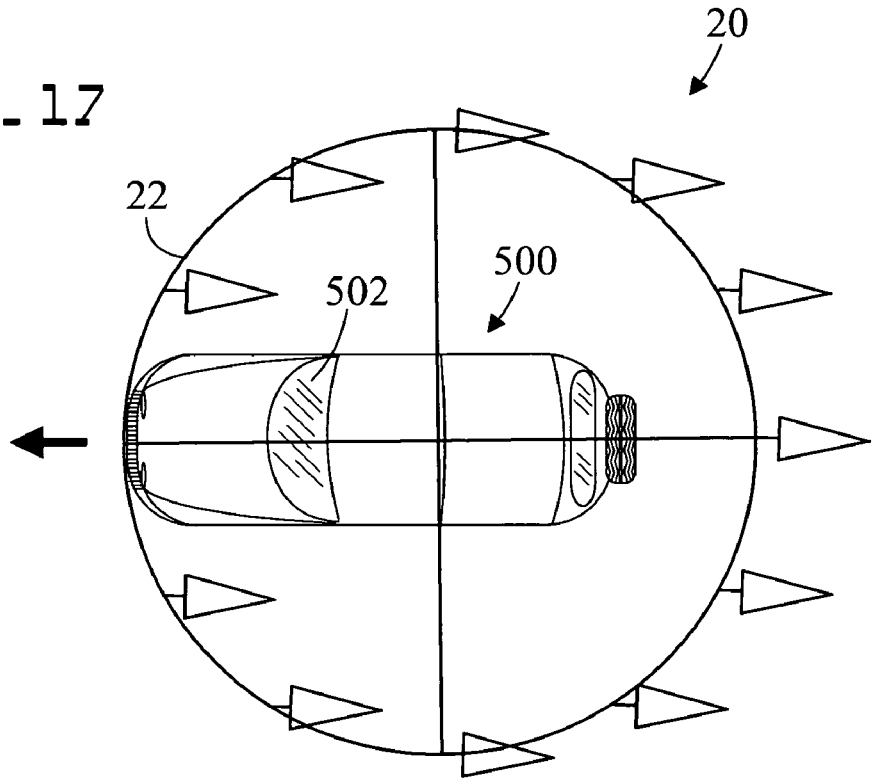
FIG. 17 is a reduced top plan view of the device surrounding the motor vehicle.

In the shown embodiment, enclosure 22 is circular (a circular sleeve in the form of a wall) and completely surrounds motor vehicle 500 (refer also to FIG. 17). A circular configuration is preferred to a rectangular configuration because the distance across the enclosure always remains the same no matter which segment is actually in front of the motor vehicle. It is anticipated that the enclosure 22 will rotate under the helicopter 700. By having a circular configuration, the distance across the enclosure will always be the same and the helicopter pilot will not have to worry about which particular segment of the enclosure is in front before he drops the enclosure. In contrast, the helicopter pilot would have to be concerned about which side of a rectangular enclosure (FIG. 12) is in front before he drops it on a motor vehicle because the distances across are different depending upon the orientation.

In one embodiment, enclosure 22 is nontransparent so as to block the driver's 504 view of the surrounding driving environment through windows 502 (and particularly the windshield) of motor vehicle 500. As such, when device 20 encloses motor vehicle 500 (refer to FIGS. 16-18), driver 504 cannot see the surrounding driving environment and will be strongly motivated to stop motor vehicle 500.

Figure 19:
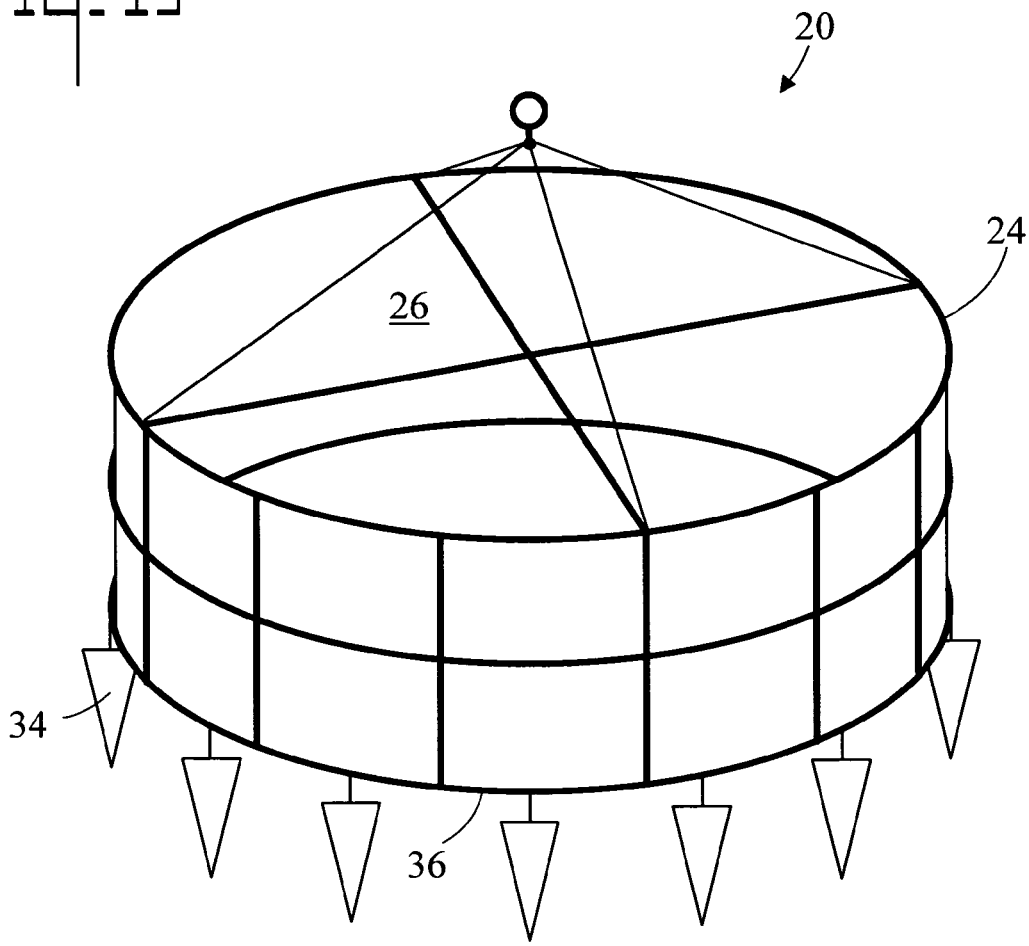
FIG. 19 is a perspective view of an enclosure for arresting a motor vehicle similar to FIG. 6 with the non-transparent sheet on the inside of the frame; and, FIG. 20 is a reduced side elevation view similar to FIG. 14 of the device being lowered toward a motor boat.

In the shown embodiment, device 20 includes a frame 24 (also refer to FIG. 9) which is covered by a nontransparent sheet 26 such as of canvas, a woven or sheet polymer, or a metal such as aluminum to form enclosure 22. In FIG. 6, sheet 26 is on the outside of frame 24. In FIG. 19, sheet 26 is on the inside of frame 24. One advantage of having the frame 24 on the outside of the sheet 26 is that the driver of the stopped vehicle cannot use the frame to lift the enclosure 22 to escape underneath. One advantage of having the frame 24 on the inside is that it is possible to stretch the fabric of the sheet over the frame and keep it in place partially by friction. The height H of enclosure 22 is sufficient to block the view of driver 504 of motor vehicle 500.

A coupling 28 is connected to enclosure 22 by a plurality of cables (or chains) 30. Coupling 28 is releasably connectable to the quick release lifting hook 702 of helicopter 700, so that device 20 can be attached to and suspended from helicopter 700 (refer to FIG. 13). Enclosure 22 can further include cross braces 32 which provide strength and rigidity, and also in some instances keep enclosure 22 from dropping below the roof line of motor vehicle 500. Device 20 can also include a plurality of colored pennants 34 which are attached to the bottom edge 36 of enclosure 22. Blowing colored pennants 34 draw attention to device 20 as it is being deployed by helicopter 700 and are a visual aid to the helicopter pilot when positioning enclosure 22.

Figure 9:
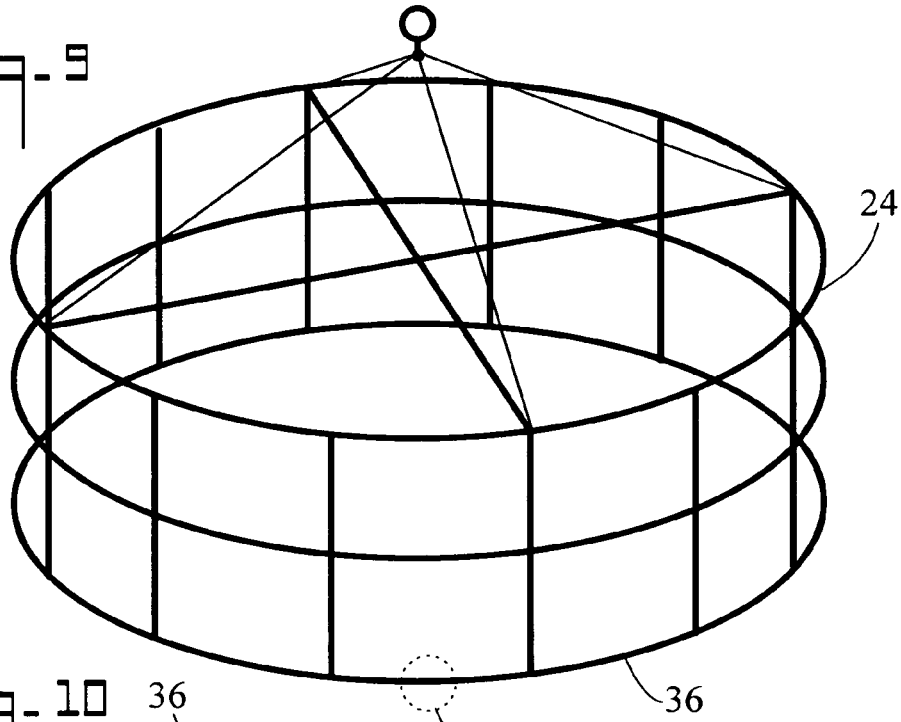
FIG. 9 is a perspective view of a frame.

FIG. 9 is a perspective view of frame 24 of enclosure 22 (refer to FIGS. 6-8). Frame 24 is rigid (made from metal bars), and has a cage-like shape.

Figure 10:
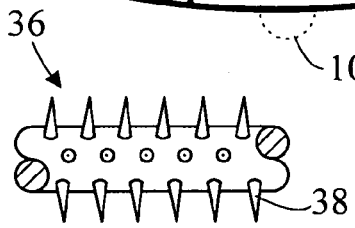
FIG. 10 is an enlarged view of area 10 of FIG. 9.

FIG. 10 is an enlarged view of area 10 of FIG. 9. Enclosure 22 has a bottom edge 36. A plurality of sharp elements (such as spikes) 38 can be disposed on bottom edge 36. Sharp elements 38 discourage the driver from trying to lift enclosure 22 and escape on foot. It is noted that sharp elements 38 could also be disposed on other portions of enclosure 22.

Figure 11:
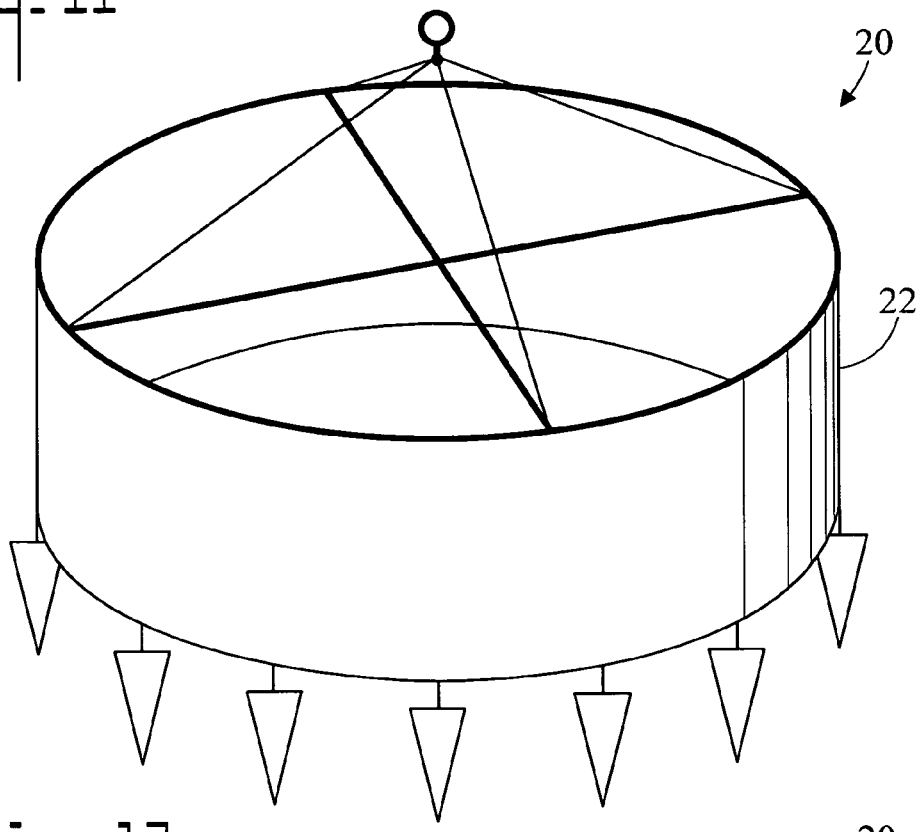
FIG. 11 is a perspective view of another embodiment of the device.

FIG. 11 is a perspective view of another embodiment of device 20. In this embodiment enclosure 22 is fabricated from a solid nontransparent material such as a polymer or aluminum sheet.

Figure 12:
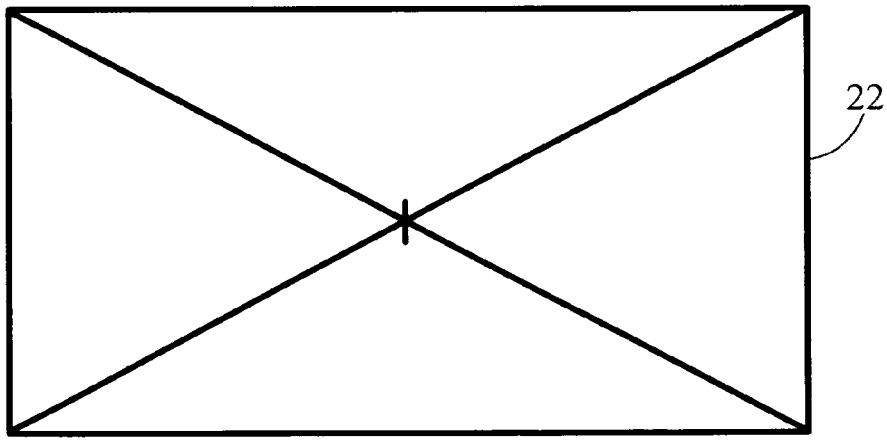
FIG. 12 is a top plan view of another embodiment of the device.

FIG. 12 is a top plan view of another embodiment of device 20. In this embodiment enclosure 22 is rectangular. A tail might be added to one of the narrow sides to keep the rectangular form from rotating when suspended from a helicopter. It may be appreciated that other shapes of enclosure 22 are also possible.

Figure 18:
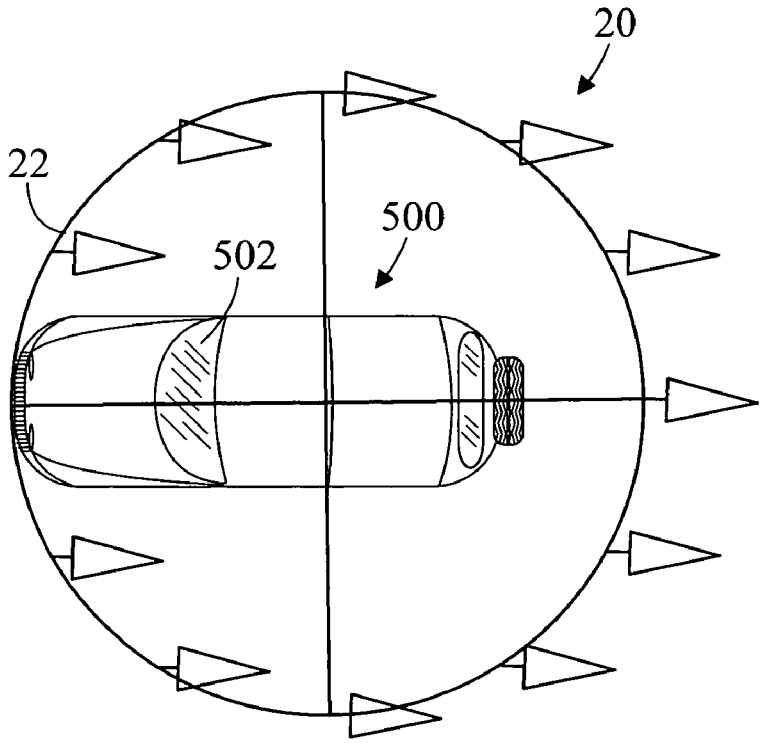
FIG. 18 is a reduced top plan view of the motor vehicle stopped by the device.

FIGS. 13-18 depict the sequence of using device 20. To that end, a method for arresting a motor vehicle 500 and a driver 504 which are moving on a support surface 600 includes:

(a) providing a moving motor vehicle 500 having windows 502 through which driver 504 views a surrounding driving environment;

(b) providing a support surface 600 upon which the motor vehicle 500 is moving;

(c) providing a helicopter 700;

(d) providing a device 20 for arresting motor vehicle 500, device 20 including;

an enclosure 22 which is shaped and dimensioned to receive motor vehicle 500; and, device 20 releasably connectable to helicopter 702 via quick disconnect lifting hook 702, so that device 20 can be (1) positioned over motor vehicle 500 by helicopter 702 (refer to FIGS. 13 and 14), (2) disconnected from helicopter 702 (refer to FIG. 15), and (3) dropped onto support surface 600 wherein enclosure 22 encloses the motor vehicle 500 (refer to FIGS. 16-18);

(e) connecting device 20 to helicopter 700 (refer to FIG. 13);

(f) causing helicopter 700 to fly over and slightly in front of motor vehicle 500 so that device 20 is positioned above motor vehicle 500 (refer to FIGS. 13 and 14); and, (g) causing device 20 to be disconnected from helicopter 700 and drop to enclose motor vehicle 500 (refer to FIGS. 15-18). It is noted that in FIG. 18, device 20 has caused driver 504 (refer to FIG. 16) to stop motor vehicle 500.

The method further including:

in step (d), enclosure 22 being circular so that after step (g) enclosure 22 completely surrounds motor vehicle 500 (refer to FIGS. 16-18).

The method further including:

in step (d), enclosure 22 being nontransparent; and, after step (g), enclosure 22 blocking the driver's view of the surrounding driving environment through windows 502 of motor vehicle 500 (refer to FIG. 16).

The method further including:

in step (d), enclosure 22 including a frame 24 which is covered by a nontransparent sheet 26 (refer to FIG. 6).

Figure 15:
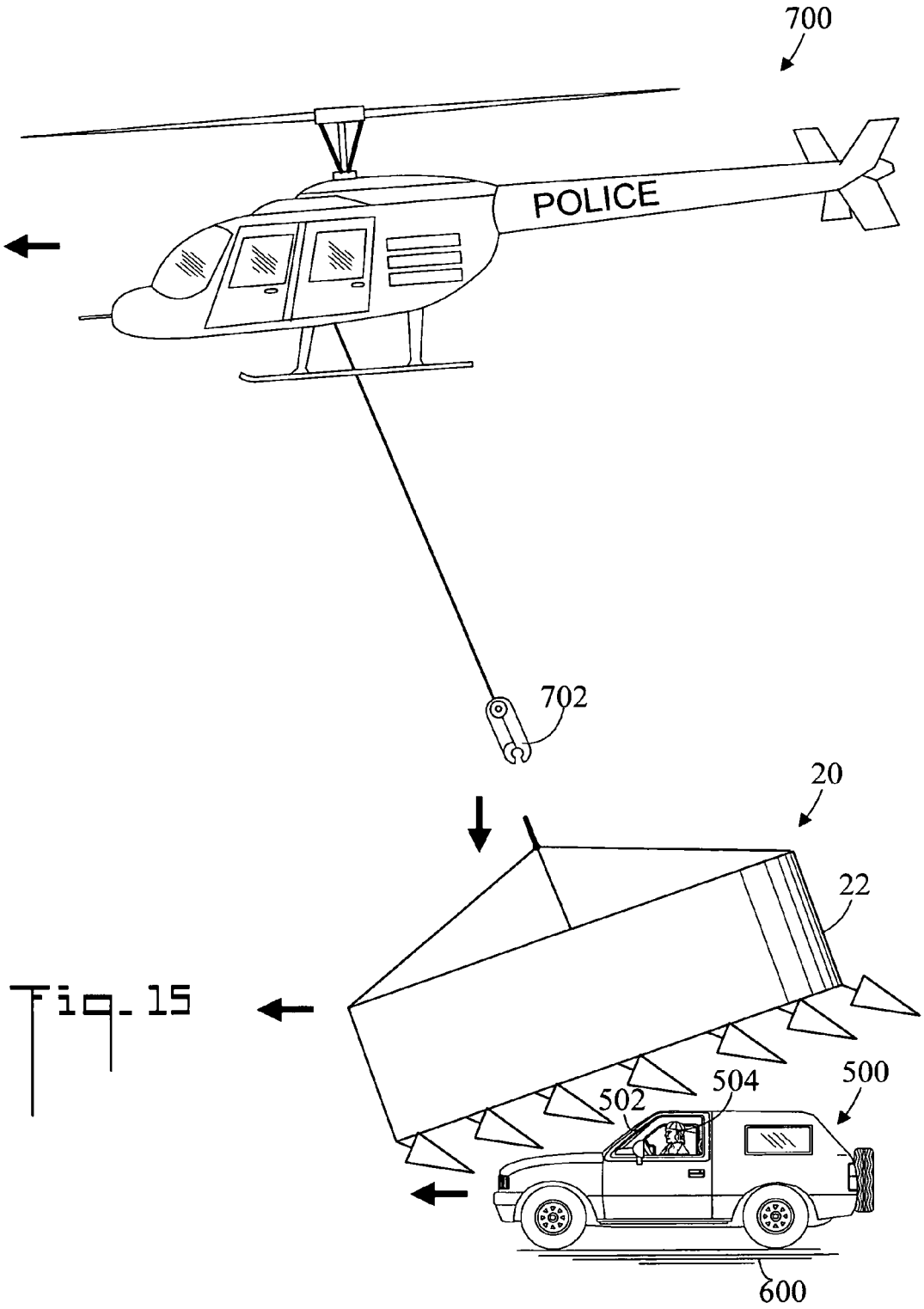
FIG. 15 is a reduced side elevation view of the device being released by the helicopter and dropping onto the motor vehicle.

The method further including:

in step (c), helicopter 700 having a cable 704 which suspends a quick release lifting hook 702 (refer to FIG. 13);

in step (d), device 20 including a coupling 28 which is connected to enclosure 22, coupling 28 releasably connectable to quick release lifting hook 702 (refer to FIG. 13); and, in step (g), quick release lifting hook 702 releasing device 20 (refer to FIG. 15).

The method further including:

in step (d), enclosure 22 having a bottom edge 36 which includes a plurality of sharp elements 38 (refer to FIGS. 9 and 10); and, after step (g), sharp elements 38 discouraging the driver from lifting enclosure 22.

The method further including:

in step (d), enclosure 22 having a bottom edge 36; and, a plurality of pennants 34 attached to bottom edge 36 (refer to FIG. 6).

After deployment of device 20, the driver of motor vehicle 500 is trapped inside enclosure 22 as shown in FIGS. 16-18 making escape by foot difficult or impossible before the police arrive on the ground.

FIG. 19 is a perspective view of an enclosure for arresting a motor vehicle similar to FIG. 6 as noted above but with the nontransparent sheet 26 on the inside of the frame 24 instead of the outside. Fabricating the enclosure 22 with the nontransparent sheet 26 on the inside of the frame 24 makes it virtually impossible for the driver to lift the enclosure by gripping the frame.

Figure 14:
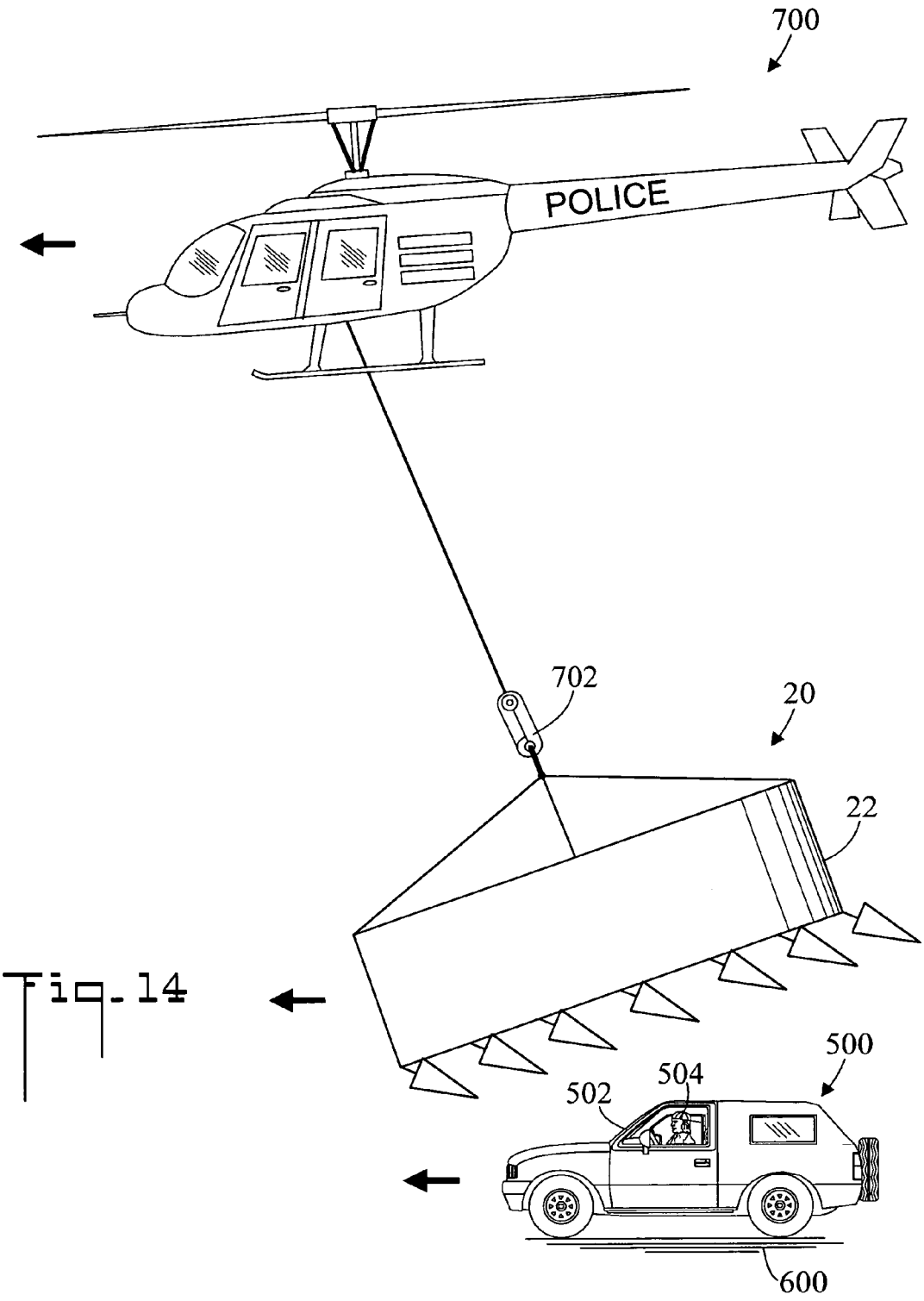
FIG. 14 is a reduced side elevation view of the device being lowered toward the motor vehicle.
Figure 20:
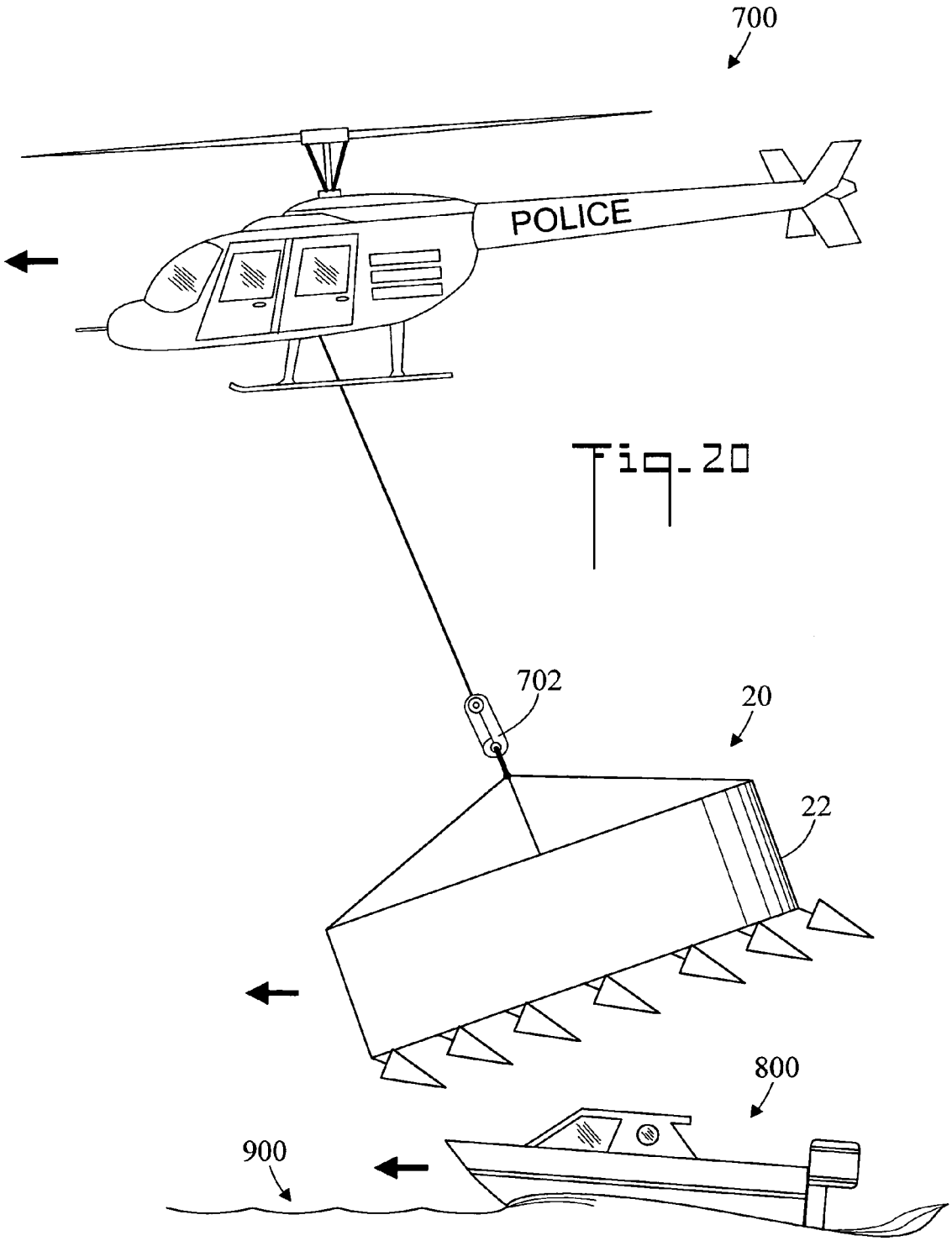

FIG. 20 is a reduced side elevation view similar to FIG. 14 of the device 20 being lowered toward a motor boat 800. Device 20 can be used to arrest a boat on the water 900. Cross braces 32 keep the enclosure 22 on the boat 700 after it is dropped.

The possible embodiments of the device and its method of use described herein are exemplary and numerous modifications, variations, and rearrangements can be readily envisioned to achieve an equivalent result, all of which are intended to be embraced within the scope of the appended claims.

I claim:

1. A device for arresting a motor vehicle which is moving on a support surface as the driver views a surrounding driving environment, the device deployed by a helicopter, the device comprising:

an enclosure that is a sleeve in the form of a wall which is shaped and dimensioned to receive the motor vehicle; and, said device releasably connectable to the helicopter, so that said device can be (1) positioned over the motor vehicle by the helicopter, (2) disconnected from the helicopter, and (3) drop onto the support surface wherein said enclosure encloses the motor vehicle.

2. The device according to claim 1, further including:

said enclosure being circular and completely surrounding the motor vehicle.

3. The device according to claim 1, further including:

said enclosure being nontransparent so as to block the driver's view of the surrounding driving environment.

4. The device according to claim 3, further including:

said enclosure including a frame which is covered by a nontransparent sheet on the outside of the frame.

5. The device according to claim 3, further including:

said enclosure including a frame which is covered by a nontransparent sheet on the inside of the frame.

6. The device according to claim 3, further including:

said enclosure fabricated from a solid nontransparent material.

7. The device according to claim 1, further including:

said enclosure including a rigid frame made from metal bars having a bottom edge; and, a plurality of sharp spikes disposed on said bottom edge.

8. The device according to claim 1, further including:

said enclosure having a bottom edge; and, a plurality of pennants attached to said bottom edge.

9. The device according to claim 1, the helicopter having a quick release lifting hook, the device further including:

a coupling connected to said enclosure; and, said coupling releasably connectable to the quick release lifting hook.

10. The device according to claim 1, the helicopter having a quick release lifting hook, the device further including:

said enclosure being circular and completely surrounding the motor vehicle;

said enclosure being nontransparent so as to block the driver's view of the surrounding environment;

said enclosure including a frame which is covered by a nontransparent sheet;

said enclosure having a bottom edge;

a plurality of sharp elements disposed on said bottom edge;

a plurality of pennants attached to said bottom edge;

a coupling connected to said enclosure; and, said coupling releasably connectable to the quick release lifting hook.

11. A motor vehicle arresting system, comprising:

a motor vehicle moving on a support surface;

a helicopter;

a device for arresting said motor vehicle, said device including;

an enclosure that is a sleeve in the form of a wall which is shaped and dimensioned to receive said motor vehicle; and, said device releasably connectable to said helicopter, so that said device can be (1) positioned over said motor vehicle by said helicopter, (2) disconnected from said helicopter, and (3) drop onto said support surface wherein said enclosure encloses said motor vehicle.

12. A device for arresting a motor vehicle which is moving on a support surface as the driver views a surrounding driving environment, the device deployed by a helicopter, the device comprising:

an enclosure which is shaped and dimensioned to receive the motor vehicle;

said device releasably connectable to the helicopter, so that said device can be (1) positioned over the motor vehicle by the helicopter, (2) disconnected from the helicopter, and (3) drop onto the support surface wherein said enclosure encloses the motor vehicle;

said enclosure being nontransparent so as to block the driver's view of the surrounding driving environment; and, said enclosure including a frame which is covered by a nontransparent sheet on the outside of said frame.

13. A device for arresting a motor vehicle which is moving on a support surface as the driver views a surrounding driving environment, the device deployed by a helicopter, the device comprising:

an enclosure which is shaped and dimensioned to receive the motor vehicle;

said device releasably connectable to the helicopter, so that said device can be (1) positioned over the motor vehicle by the helicopter, (2) disconnected from the helicopter, and (3) drop onto the support surface wherein said enclosure encloses the motor vehicle;

said enclosure being nontransparent so as to block the driver's view of the surrounding driving environment; and, said enclosure including a frame which is covered by a nontransparent sheet on the inside of said frame.

14. A device for arresting a motor vehicle which is moving on a support surface as the driver views a surrounding driving environment, the device deployed by a helicopter, the device comprising:

an enclosure which is shaped and dimensioned to receive the motor vehicle;

said device releasably connectable to the helicopter, so that said device can be (1) positioned over the motor vehicle by the helicopter, (2) disconnected from the helicopter, and (3) drop onto the support surface wherein said enclosure encloses the motor vehicle;

said enclosure being nontransparent so as to block the driver's view of the surrounding driving environment; and, said enclosure fabricated from a solid nontransparent material.

15. A device for arresting a motor vehicle which is moving on a support surface as the driver views a surrounding driving environment, the device deployed by a helicopter having a quick release lifting hook, the device comprising:

an enclosure which is shaped and dimensioned to receive the motor vehicle;

said device releasably connectable to the helicopter, so that said device can be (1) positioned over the motor vehicle by the helicopter, (2) disconnected from the helicopter, and (3) drop onto the support surface wherein said enclosure encloses the motor vehicle;

said enclosure being circular and completely surrounding the motor vehicle;

said enclosure being nontransparent so as to block the driver's view of the surrounding driving environment;

said enclosure including a frame which is covered by a nontransparent sheet;

said enclosure having a bottom edge;

a plurality of sharp elements disposed on said bottom edge;

a plurality of pennants attached to said bottom edge;

a coupling connected to said enclosure; and, said coupling releasably connected to the quick release lifting hook.

* * * * *